United States Patent [19]

Greive

[11] 4,091,604

[45] May 30, 1978

[54] DEVICE FOR THE DRIVING OF YARN-TAKEUP PACKAGES, ESPECIALLY FOR DOUBLE TWISTING MACHINES

[75] Inventor: Aloys Greive, Munster, Germany

[73] Assignee: Hamel GmbH, Zwirnmaschinen, Munster, Germany

[21] Appl. No.: 783,491

[22] Filed: Mar. 31, 1977

[30] Foreign Application Priority Data

Apr. 1, 1976 Germany ..... 2614103

[51] Int. Cl.[2] ..... D01H 1/10; D01H 1/20; B65H 54/42

[52] U.S. Cl. ..... 57/34 R; 57/62; 57/80; 242/18 DD; 242/46.2

[58] Field of Search ..... 57/78, 80, 66, 92, 1 R, 57/34 R, 81, 59, 60, 61, 58.52, 58.65, 58.49, 58.7, 58.72; 242/18 DD, 46.2, 46.4

[56] References Cited

U.S. PATENT DOCUMENTS

| | | | |
|---|---|---|---|
| 2,944,382 | 7/1960 | Batty et al. | 57/62 |
| 3,615,060 | 10/1971 | Jenny | 242/18 DD |
| 3,825,195 | 7/1974 | Miller | 242/18 DD |
| 3,833,179 | 9/1974 | Maurer | 242/46.4 |
| 3,864,901 | 2/1975 | Beymes et al. | 57/58.49 X |
| 3,917,182 | 11/1975 | Lenke | 242/18 R |
| 3,945,579 | 3/1976 | Schippers et al. | 242/18 DD |
| 3,977,615 | 8/1976 | Owens et al. | 242/18 DD X |
| 4,043,517 | 8/1977 | Jährig | 242/18 DD |

*Primary Examiner*—Donald Watkins
*Attorney, Agent, or Firm*—Karl F. Ross

[57] ABSTRACT

A device for the peripheral drive of the yarn-takeup package of a double twisting machine, i.e. a so-called DD twister, comprises a coupling sleeve freely rotatable and axially shiftable on a drive shaft, the coupling sleeve being angularly entrained with the axially fixed winding cylinder and connectible with a hub angularly entrained with the drive shaft. The coupling sleeve is shifted in response to the position of a thread-sensing element from its coupled state into a free-running condition.

9 Claims, 3 Drawing Figures

DEVICE FOR THE DRIVING OF YARN-TAKEUP PACKAGES, ESPECIALLY FOR DOUBLE TWISTING MACHINES

FIELD OF THE INVENTION

The present invention relates to a device for the peripheral drive of a takeup package (yarn package) especially for double twisting machines (so-called DD twisters). More particularly, the invention relates to a device of the aforedescribed type which comprises a windup cylinder which can be releasably coupled to a drive shaft but can be freely rotatable (freewheeling) relative thereto.

BACKGROUND OF THE INVENTION

In textile machines, especially DD twisters and other double-twist spinning machines, provided with a multiplicity of bobbins from which yarns can be fed to the respective yarn packages, it is desirable, for various purposes, to be able to individually and independently terminate rotation of each yarn package.

For example, it is necessary to bring the respective yarn package to a standstill when there is a break in the thread fed thereto since knotting of the yarn ends is then required. It is also desirable to halt rotation of the yarn package when the bobbin or spool from which the yarn is fed to the package must be removed (i.e. is empty) and replaced.

In addition, it is desirable to selectively bring the takeup spool or yarn package to standstill when a predetermined length of yarn has been wound thereon or when the takeup spool has the desired diameter for further processing.

It is important to bring the yarn package to standstill without an extensive free-running contact between the takeup spool or package and the coiling cylinder which frictionally drives the package by contact with the periphery thereof, since a constant friction is otherwise applied to the outer turns of the yarn and may cause them to become loose from the package and become tangled. In addition, continuous frictional contact of the aforedescribed type tends to damage the yarn on the surface of the yarn package or takeup spool.

To interrupt the drive between the takeup spool and the coiling cylinder which is used to rotate the spool or package, there have been two principal techniques.

In the first approach, the takeup spool or yarn package is rotatable in a spool frame which is swung upwardly to terminate the contact with the continuously rotating coiling cylinder upon which the yarn package otherwise rests. The swinging movement is effected by a lifting rod which is controlled by a thread monitoring device. Alternatively, a slider can be provided which is introduced between the yarn package and the coiling cylinder to separate the two.

In the second approach, the winding cylinder is decoupled (declutched) to disconnect it from the drive shaft so that both the takeup spool and yarn package and the coiling cylinder simultaneously are brought to standstill.

German published application (Auslegeschrift) DT-AS 1 785 410 discloses a device operating in accordance with the principles of the second technique, whereby the coiling cylinder is connected with the drive shaft with a jaw clutch.

The drive shaft is provided with a hub having an axially turned end face provided with a toothed crown, this hub being angularly fixed to the drive shaft, i.e. continuously rotated therewith without slip therebetween. The toothed crown engages a meshing toothed crown provided at an axial end of the coiling cylinder and hence drives the latter. The coiling cylinder is loosely journaled upon the drive shaft via antifriction or slide bearings. A permanent magnet in the rotating hub cooperates with a steel ring within the coiling cylinder to stabilize the meshing of the teeth of the confronting crowns thereof. Parallel to the coiling cylinder a rod is axially shiftable and carries at both ends actuating fingers which embrace the ends of the coiling cylinder as a shifting fork. Upon displacement of this rod parallel to the axis of the coiling cylinder, the teeth of the latter are withdrawn from engagement with the axially fixed hub.

A thread-sensor control device, responsive to thread breakage, laterally shifts the rod and its actuating fingers. One of the fingers is thus effective to draw the coiling cylinder out of engagement with the hub carried by the shaft along the latter. When the thread sensor is again brought into its operating position, the movement thereof causes a displacement of the rod in the opposite direction so that the other finger becomes effective to shift the coiling cylinder into meshing engagement with the toothed hub.

Since the takeup spool or yarn package rests with its entire weight constantly upon the coiling cylinder during the coupling and decoupling thereof from the drive hub of the shaft, the axial displacement of the coiling cylinder parallel to the longitudinal axis of the spool or yarn package and relative thereto readily rubs loose the outer turns of the yarn and/or damages them. Instantaneous connection and disconnection of the coiling cylinder after a thread break using the device described has been found, in practice, to cause downwardly hanging yarn ends to readily become engaged with the neighboring spindle and here induce a further thread breakage.

German utility model (Gebrauchsmusterschrift) DT-GbmS No. 7 126 199 also discloses a roller which has a braking surface. The latter, upon axial shifting of the roller against an oppositely turned braking surface by an electromagnet, causes coupling thereof. The electromagnet can be switched by circuitry triggered by a thread-guide device. So that the broken yarn end can be coiled up, the electromagnet is switched on through a time delay relay. This arrangement has been found to be relatively costly since, for each coiling cylinder, an electromagnet with associated electrical installation must be provided. In addition, the disadvantages arising upon axial shifting of the roller, as described above, remain.

OBJECTS OF THE INVENTION

It is an object of the present invention to provide a device for enabling the yarn package of a twisting machine to be brought to standstill in a convenient manner.

Another object of the invention is to provide an improved device for the aforedescribed purposes with a relatively simple construction whereby the drive connection between the coiling cylinder and the drive shaft can be interrupted without the aforedescribed disadvantages and without interference with neighboring spindles or damage to the takeup coil or yarn package.

It is another object of the invention to provide a device for bringing a yarn package to standstill in a convenient and economical manner, especially in a double twisting machine.

SUMMARY OF THE INVENTION

These objects and others which will become apparent hereinafter are attained, in accordance with the present invention, by providing an improved clutch between the drive shaft and the coiling cylinder upon which the yarn package or takeup coil rests and which peripherally engages the yarn package to rotate the same.

The clutch, according to the present invention, comprises a coupling sleeve which is freely rotatable upon the drive shaft and is axially shiftably mounted thereon and which is angularly connected to the coiling cylinder. The other member of the clutch comprises a hub angularly fixed on the drive shaft and the coupling sleeve is responsive to the position of a thread-sensing element which operates a shifting mechanism which displaces the sleeve from its engaged position into a free-running position.

The term "axially fixed" is intended to indicate that, relative to the shaft, the hub and coiling cylinder are both not axially displaceable. The expression "angularly fixed" or the comparable expressions "angularly entrained" is intended to indicate that the part is rotatable with the part to which it is fixed and does not rotate relatively thereto.

Since the distance between the individual coiling cylinders must be held as small as possible, the coiling cylinder according to the invention has, at one end, an open recess which accommodates at least a portion of the coupling sleeve, the angular connection between the coiling cylinder and the coupling sleeve being effected by a radially outwardly extending first projection or formation on the coupling sleeve and a radially inwardly directed abutment formed on the inner periphery of the coiling cylinder.

For similar reasons, it has been found to be advantageous to provide the coupling sleeve at its end turned away from the coiling cylinder, with an axial recess in which the axially fixed hub is received. In the region of this recess, the coupling sleeve carries a radially outwardly extending second abutment which is engageable by a second entraining projection on the hub.

The second entraining projection can thus be a pin extending parallel to the drive shaft and receivable in the recess of the coupling sleeve. This has been found to have a highly compact space-saving construction in which the active elements of the clutch are practically completely protected against contamination by foreign matter so that reliable operation without adverse effect by external influences, is ensured.

To shift the coupling sleeve from its free-running position into its engaged or coupled position, and to hold the coupling sleeve firmly in this coupling position, the coupling sleeve is preferably biased in the direction of the hub which is angularly fixed to the drive shaft. To this end, an axially effective compression spring can be provided which is seated, at one end, against a journaling hub of the coiling cylinder and at the other end bears against the coupling sleeve.

To insure that the broken yarn end is completely wound up, a delayed release of the coiling cylinder is desired, i.e. it is advantageous to delay declutching of the coiling cylinder from the drive shaft. To this end, the shifting mechanism can be designed, for example, such that the periphery of the coupling sleeve is provided with a screw thread which is engaged by a member axially fixed to the drive shaft and which, in response to the thread-sensing device, is brought into play. As the latter member engages the screw thread and relative rotation of the coupling sleeve and the shaft is effected, the coupling sleeve is axially shifted into its free-running position.

According to a preferred embodiment of the invention, the screw thread on the periphery of the coupling sleeve projects axially from an end of the coiling cylinder. This projecting end of the coupling sleeve is formed as a hollow cylinder.

In a particularly simple and reliable construction, the member which engages the screw thread is formed as a bellcrank lever which is swingable about an axis parallel to the drive shaft, one end of this bellcrank lever (i.e. one arm thereof) being formed with a guide cam approximately at right angles for engagement in the screw thread. The other arm of the bellcrank lever, which extends To insure that the broken yarn end is completely wound up, a delayed release of the coiling cylinder is desired, i.e. it is advantageous to delay declutching of the coiling cylinder from the drive shaft. To this end, the shifting mechanism can be designed, for example, such that the periphery of the coupling sleeve is provided with a screw thread which is engaged by a member axially fixed to the drive shaft and which, in response to the thread-sensing device, is brought into play. As the latter member engages the screw thread and relative rotation of the coupling sleeve and the shaft is effected, the coupling sleeve is axially shifted into its free-running position.

According to a preferred embodiment of the invention, the screw thread on the periphery of the coupling sleeve projects axially from an end of the coiling cylinder. This projecting end of the coupling sleeve is formed as a hollow cylinder.

In a particularly simple and reliable construction, the member which engages the screw thread is formed as a bellcrank lever which is swingable about an axis parallel to the drive shaft, one end of this bellcrank lever (i.e. one arm thereof) being formed with a guide cam approximately at right angles for engagement in the screw thread. The other arm of the bellcrank lever, which extends substantially perpendicularly to the axis of the drive shaft, is engaged by a bent member of a thread-monitoring sensor which, upon swinging of the sensor because of a tear of the thread or the passage of a thread end therethrough, swings, in turn, the bellcrank lever in the sense required to bring its guide cam into the screw thread. For the decoupling of the coiling cylinder, the swinging movement of the bellcrank lever can be effected by release of the latter via the setting yoke if, in accordance with the invention, the bellcrank lever has its second arm biased against the bent member by the effect of gravity, i.e. is weighted to bear thereagainst.

Brief Description of the Drawing

The above and other objects, features and advantages of the present invention will become more readily apparent from the following description, reference being made to the accompanying drawing in which.

SPECIFIC DESCRIPTION

Figure 1:
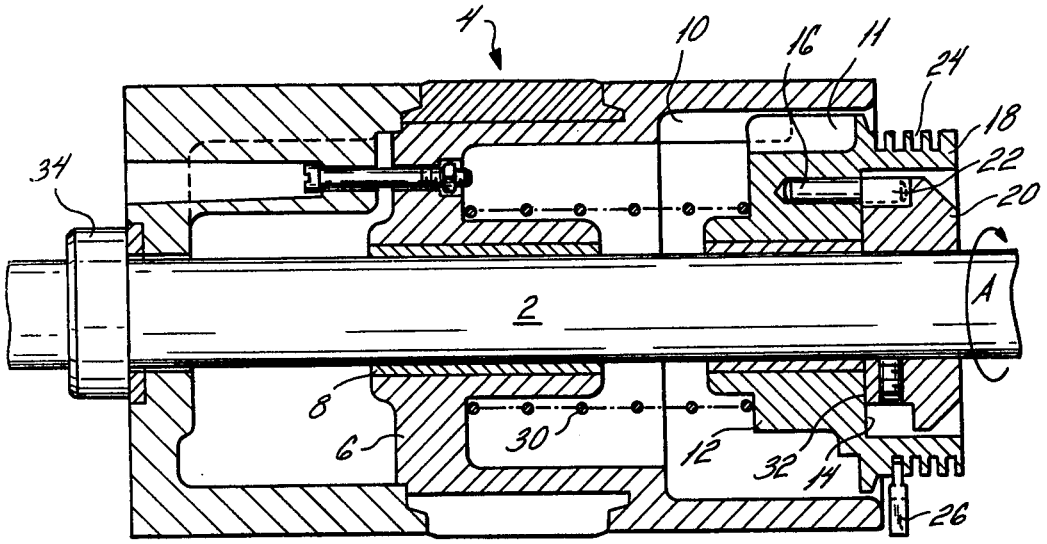
FIG. 1 is a longitudinal cross section through a coiling cylinder in its operating condition, according to the present invention.
Figure 2:
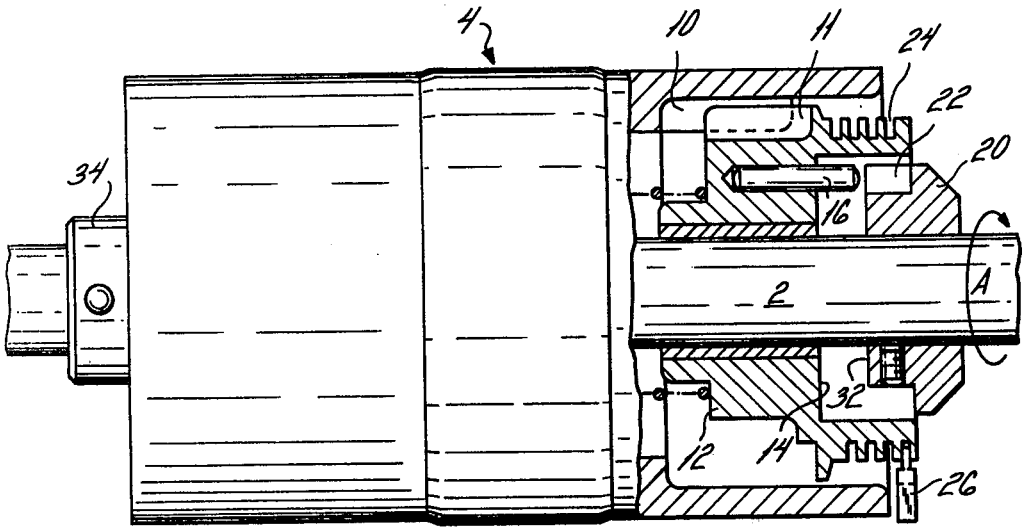
FIG. 2 is a partial section of the coiling cylinder in the decoupled state.

FIGS. 1 and 2 show a coiling drive for a yarn package (see FIG. 3) of a double twister machine upon which the yarn package or takeup spool rests.

The apparatus comprises a drive shaft 2 which extends along the machine or frame and is driven by means not shown in the direction represented by the arrow A. For each twisting station, a coiling cylinder 4 is provided along the shaft 2 and is freely rotatable thereon via a bearing hub 6 and a sleeve bearing 8.

The coiling cylinder 4 is formed in part as a hollow cylindrical body which is open at one axial end, i.e. the right hand end as shown in FIGS. 1 and 2. In the region of this end, the coiling cylinder is provided with a radially inwardly extending rib-like abutment 10. The drive shaft 2 also carries a coupling sleeve in the form of an axially shiftable flange 12, the latter being free to rotate upon the shaft 2 by a corresponding sleeve bearing, the flange 12, in its coupled state, penetrating about half its length into the open end of the coiling cylinder 4 and engaging, with an outwardly projecting entraining formation 11, the abutment 10.

The flange or coupling sleeve 12 is provided, at its end turned away from the coiling cylinder 4, with an axially open recess 14 in which the coupling hub 20 affixed to the shaft 2 by a set screw, is receivable.

In an axial end face of this coupling sleeve 12, there is provided an axially extending pin 16 which projects axially and can be received within a notch forming a radially outwardly extending abutment 22 on the hub 20.

Along its outer periphery in the region in which the sleeve 12 projects from the coiling cylinder 4, the coupling sleeve 12 is formed with a screw thread 24 in which a guide cam 26 of a pawl 28, formed as a bellcrank lever, can engage.

Between the journal hub 6 and the flange or coupling sleeve 12, there is provided a compression spring 30 which is coaxial with the drive shaft 2 and is under axial prestress so that it bears axially upon the flange 12 to urge it into its coupling position (FIG. 1) in which the pin 16 engages the formation 22. In this position (FIG. 1) the end wall of the recess 14 abuts the oppositely facing end wall 32 of the hub 20. Axial displacement of the coiling cylinder 4 in the opposite direction is prevented by a setting ring 34 anchored to the shaft 2.

During the twisting process (FIG. 3) the thread sensor 26 rests upon the tensioned yarn 38 and, via the yoke 40 connected to this sensor 36, holds the arm 44 of the bellcrank lever 28 in its solid line position. The guide cam 26 thus lies outside the screw thread 24.

Figure 3:
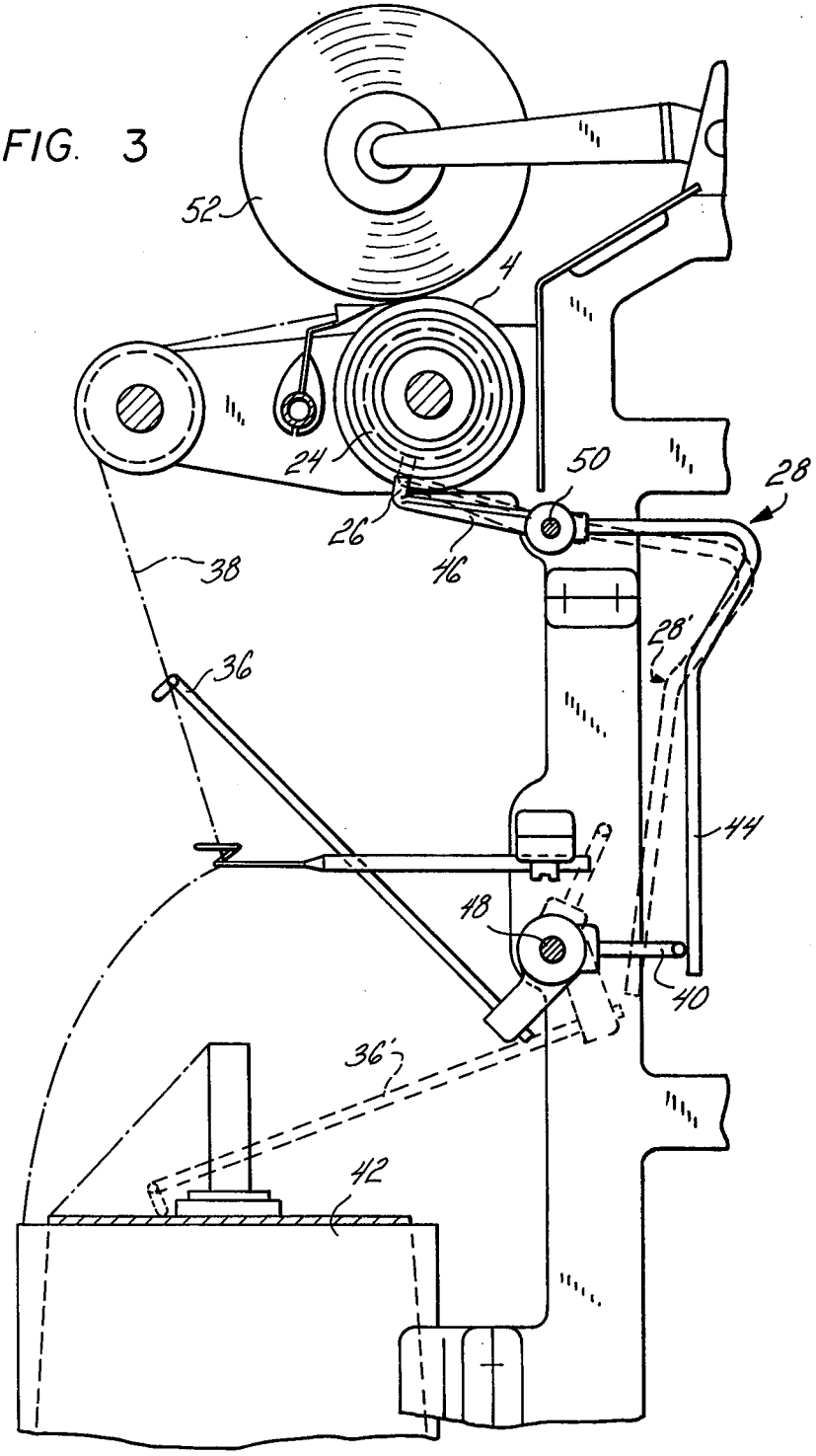
FIG. 3 is a schematic partial end view, partly in section, through a twister frame provided with a coiling cylinder of the present invention and the thread-sensing arrangement.

Should the yarn 38 become tension free, for example as a result of thread breakage or release of the end of the yarn from the supply bobbin or spool 42 of the twisting spindle, the thread sensor 38 swings counterclockwise about its shaft 48, thereby lifting the bent member 40 inwardly away from the arm 44 and permitting the same to swing into its broken line position as represented at 28', the thread sensor 36 assuming the broken line position 36' illustrated in FIG. 3. The weight of arm 44 thereby causes the cam 26 to swing into the screw thread 24 in the clockwise sense about the pivot axis 50 of the bell crank lever whose arm 46 carries the cam 26.

As the shaft 2 continues to rotate, therefore, the stationary cam 26 in engagement with the screw thread 24 displaces the sleeve 12 to the left (FIGS. 1 and 2), thereby winding up the loose yarn end while gradually causing the pin 16 to recede from engagement with the rib 22 and ultimately disengaging the sleeve 12 from the hub 20 (FIG. 2) while compressing the spring 30. The coiling cylinder 4 is thereby decoupled from the shaft 2 and, since the finger 26 continues to engage the member 12, the resulting frictional action brings the yarn package 52 and the coiling cylinder 4 to standstill simultaneously.

When the thread sensor 36 is raised, it swings the bellcrank lever 28 in the counterclockwise sense about the pivot 50, thereby withdrawing the finger 26 from the screw thread 24, the finger 26 being bent at right angles to the arm 46 and extending radially with respect to the axis of shaft 2. The spring 30 then shifts the sleeve 12 to the right (FIGS. 1 and 2) until the pin 16 engages a rib 22 and surface 32 is once more abutted by the bottom of the recess 14. The winding cylinder 4 is thereupon again coupled to the shaft.

I claim:

1. A device on a twisting machine, especially a double twister, for peripherally driving a yarn package to take up a twisted yarn, said device comprising:

a drive shaft;

a coiling cylinder for each twisting station of the machine coaxial with said drive shaft and freely rotatable thereon, a respective yarn package resting upon said coiling cylinder and being peripherally rotated thereby, said coiling cylinder being axially fixed relative to said shaft;

a coupling sleeve angularly engaged by said coiling cylinder and freely rotatable on said shaft;

a hub axially fixed on said shaft and rotatably entrained therewith, said sleeve being axially shiftable relative to said coiling cylinder and said shaft toward and away from said hub, said hub and said sleeve being provided with mutually engageable formations to angularly couple said sleeve with said hub in an operative axial position of said sleeve whereby said coiling cylinder is entrained by said shaft and being disengaged in another position of said sleeve whereby said coiling cylinder can come to standstill and halt rotation of the yarn package resting thereagainst;

thread-sensing means monitoring the tension of a yarn coiled on said yarn package; and actuating means between said yarn-sensing means and said sleeve for shifting same from said operative position into said other position.

2. The device defined in claim 1 wherein said coiling cylinder is formed at one axial end with an axially open recess, said sleeve being at least partly received in said recess, said coiling cylinder having a radially inwardly projecting member and said sleeve having a radially outwardly projecting member engaging the inwardly projecting member of said cylinder within said recess whereby said sleeve is rotatably coupled with said cylinder but is axially displaceable relative thereto.

3. The device defined in claim 2 wherein said sleeve has an extremity turned away from said coiling cylinder and formed with an axially open recess receiving said hub at least in said operative position, said formations being disposed in the latter recess.

4. The device defined in claim 3 wherein said formations include a pin carried by said sleeve and extending parallel to said shaft, and a rib formed on said hub and engageable with said pin.

5. The device defined in claim 3, further comprising a compression spring coaxially surrounding said shaft and seated at one end against said coiling cylinder while bearing at its other end against said sleeve thereby urging same axially in the direction of said hub.

6. The device defined in claim 5 wherein said extremity is formed with an external screw thread, said actuating means including a pawl engageable in said thread and operated by said thread-sensing means for axially displacing said sleeve from said operative position to said other position.

7. The device defined in claim 6 wherein said extremity projects outwardly from the axially open recess in said end of said cylinder.

8. The device defined in claim 6 wherein said pawl is formed as a bellcrank lever having a first arm provided with a right-angle finger forming a guide cam engageable in said screw thread, and a second arm swingable in a direction tending to introduce said cam into said screw thread, said thread-sensing means including a lever formed with a bent member engageable with said second arm and preventing the swinging movement thereof while tension is maintained in the yarn fed to said package.

9. The device defined in claim 8 wherein said second arm is swingable to shift said cam into said screw thread by gravitational force and is held thereby against said bent member.

* * * * *